US005088130A

United States Patent [19]

Chiarella

[11] Patent Number: 5,088,130

[45] Date of Patent: Feb. 18, 1992

[54] PROTECTIVE HELMET HAVING INTERNAL REINFORCING INFRASTRUCTURE

[76] Inventor: Michele A. Chiarella, Via Vall 'Orba 22, 6977 Ruvigliana, Switzerland

[21] Appl. No.: 475,725

[22] Filed: Feb. 6, 1990

[51] Int. Cl.[5] ..... A42B 3/00

[52] U.S. Cl. ..... 2/411; 2/421

[58] Field of Search ..... 2/410, 411, 412, 414, 2/421, 425, 422

[56] References Cited

U.S. PATENT DOCUMENTS

| | | | |
|---|---|---|---|
| 1,997,187 | 4/1935 | Taylor | 2/411 |
| 4,300,242 | 11/1981 | Nava et al. | 2/412 |
| 4,317,239 | 3/1982 | Bryksa | 2/411 |
| 4,443,891 | 4/1984 | Blomgren et al. | 2/414 |
| 4,472,472 | 9/1984 | Schultz | 2/425 |
| 4,558,470 | 12/1985 | Mitchell et al. | 2/414 |
| 4,612,675 | 9/1986 | Broersma | 2/424 |
| 4,627,114 | 12/1986 | Mitchell | 2/414 |
| 4,653,123 | 3/1987 | Broersma | 2/425 |
| 4,845,786 | 7/1989 | Chiarella | 2/412 |

FOREIGN PATENT DOCUMENTS

| | | | |
|---|---|---|---|
| 96148 | 12/1983 | European Pat. Off. | 2/411 |
| 217996 | 4/1987 | European Pat. Off. | 2/411 |
| 3632525 | 3/1988 | Fed. Rep. of Germany | 2/410 |

*Primary Examiner*—Werner H. Schroeder
*Assistant Examiner*—Michael A. Neas
*Attorney, Agent, or Firm*—Nicholas L. Coch; Walter G. Marple

[57] ABSTRACT

The invention is directed to a protective helmet comprising a formed plastic foam shell having an internal plastic infrastructure embedded at least partially therein. The embedded infrastructure provides increased shock absorption characteristics for a wearer during use. The helmet can also include either a thin plastic outer microshell or a thicker relatively rigid plastic outer shell, with a padding material attached to the inner surface of the reinforced foam shell, and a retention strap attached to the plastic outer shell.

4 Claims, 7 Drawing Sheets

FIG. 1
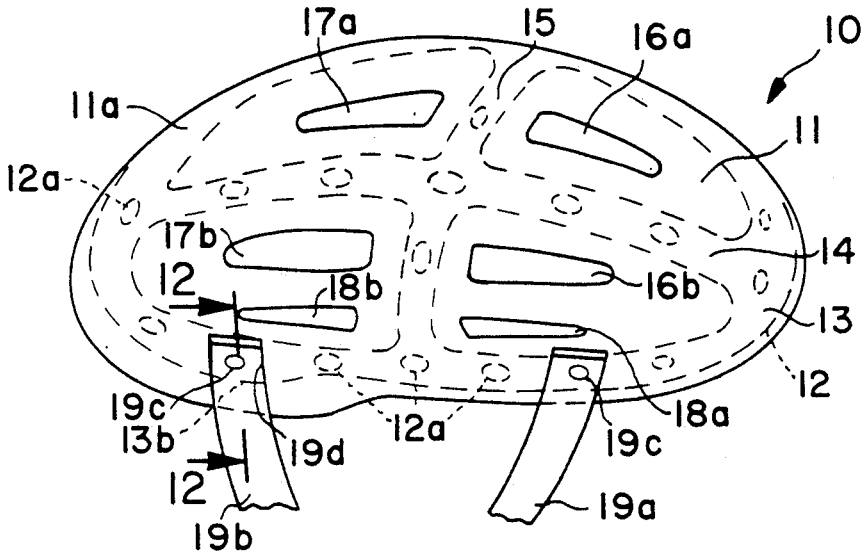
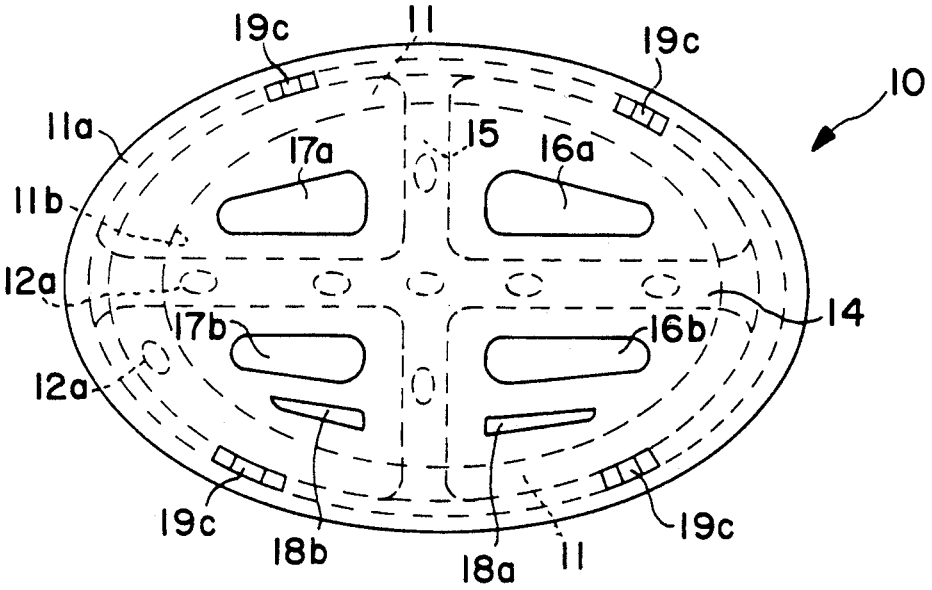
FIG. 2

FIG. 3
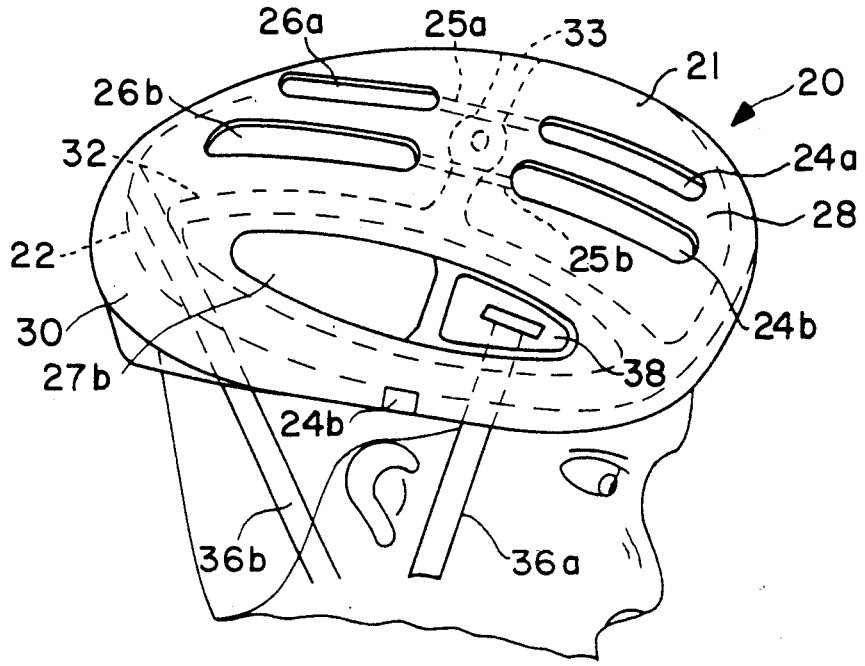
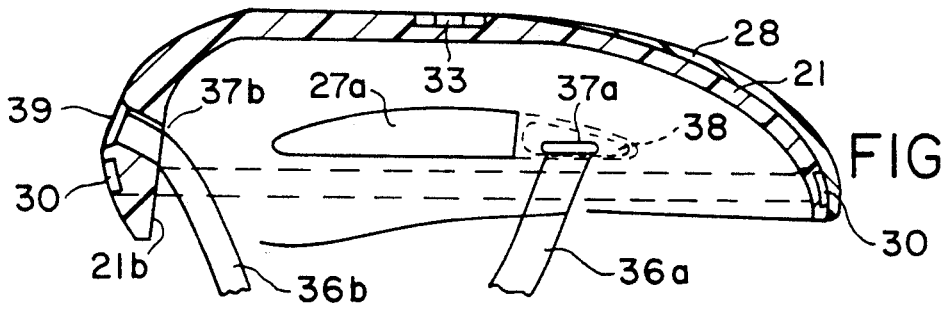
FIG. 6
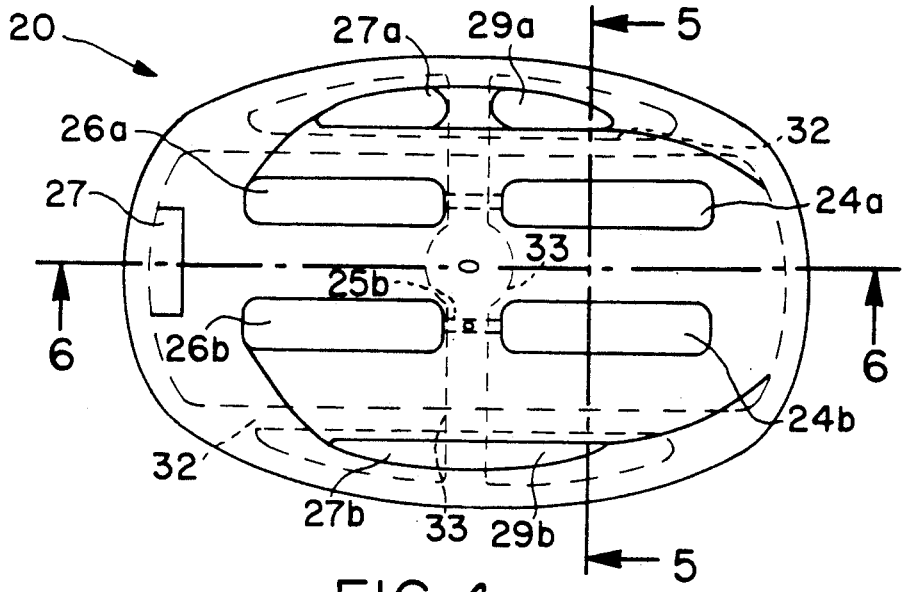
FIG. 4

FIG. 7
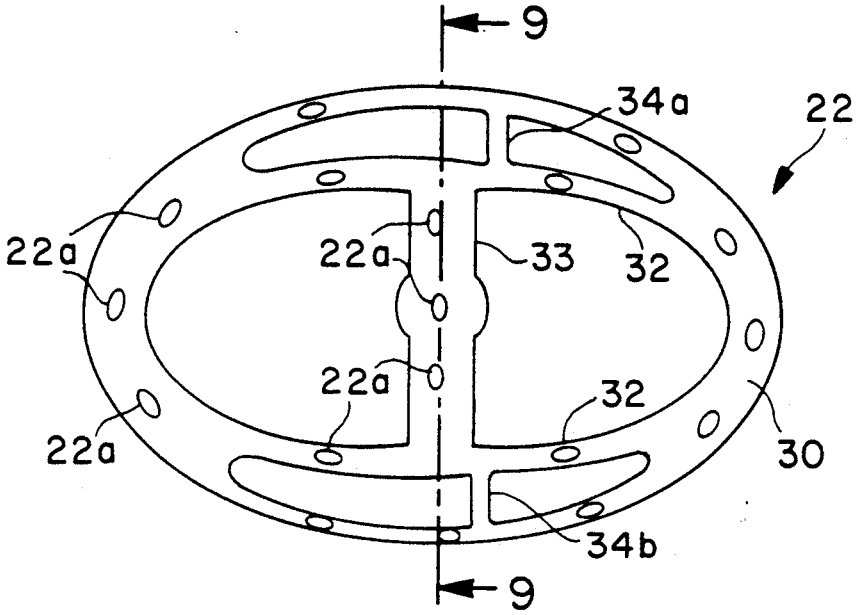
FIG. 8
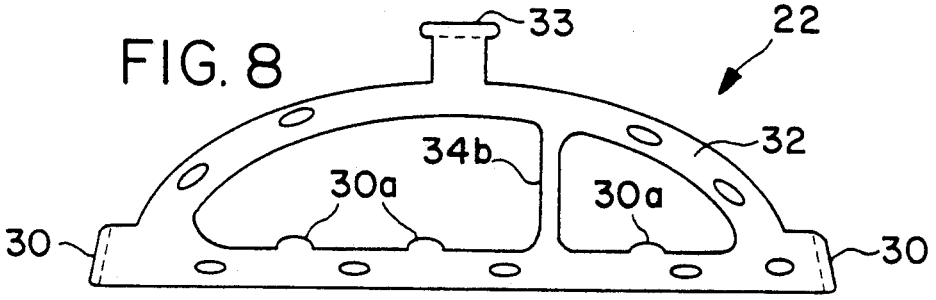
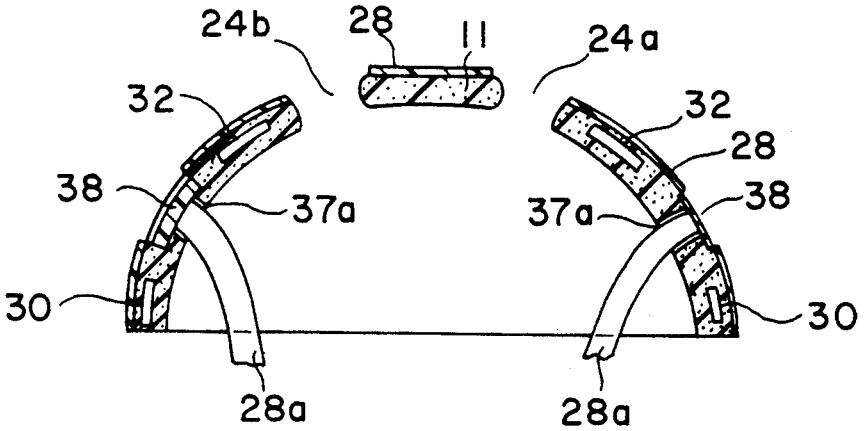
FIG. 5

FIG. 10
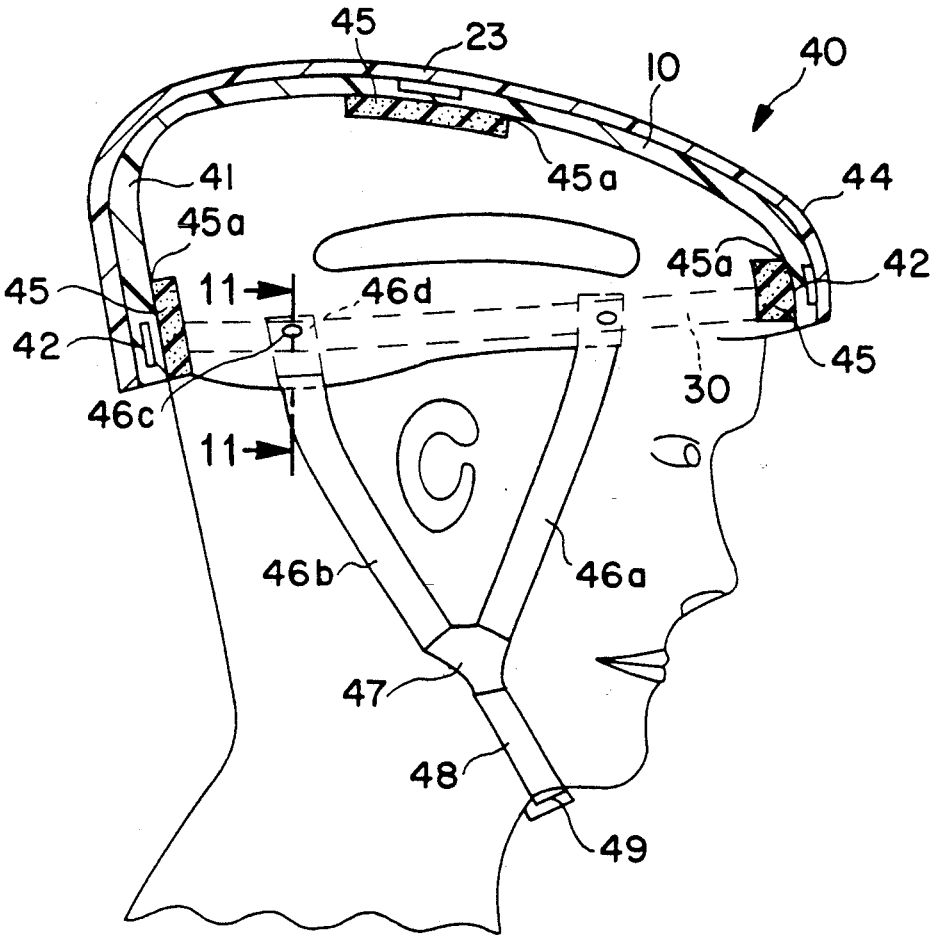
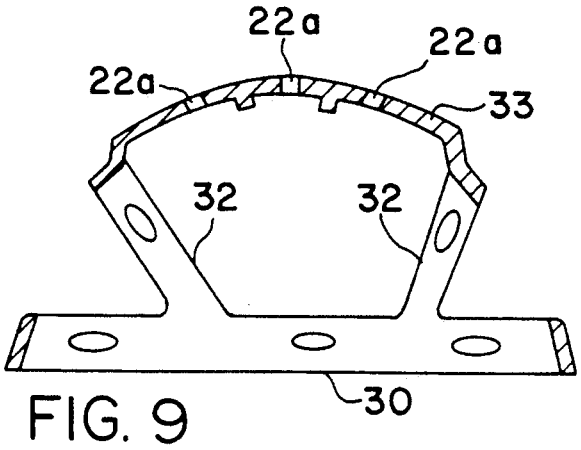
FIG. 9

PROTECTIVE HELMET HAVING INTERNAL REINFORCING INFRASTRUCTURE

FIELD OF THE INVENTION

This invention pertains to improved protective helmets, such as used by cyclists including motorcyclists and bicyclists. It pertains particularly to a protective helmet utilizing a plastic foam shell having an internal reinforcement infrastructure embedded at least partially within the foam.

BACKGROUND OF THE INVENTION

In the past, protective helmets for cyclists have been manufactured according to the configuration and structure of motorcycle helmets, which can be defined as, a hard shell type. More recently, based upon helmet users' requirements for a lightweight cycling helmet, manufacturers have used only a thick foam material. Although the foam only helmets usually provide protection, they have limited durability because the plastic foam material is easily damaged due to abrasion, bumps, scratches, and physical deterioration.

One remedy adopted to improve the durability of the plastic foam helmet has been the use of helmet covers made of fabric which, in addition to preventing damage from abrasion and scratches, also provides a decorative function. Another remedy adopted has been to include a thin outer hard plastic microshell having less thickness and weight than the traditional hard shell type helmet, but having better resistance to damage and greater durability than the fabric covered helmet, over a relatively thicker inner foam plastic shell.

Thus, based on the above description, the following general categories may be defined for protective helmets used by cyclists:

(a) hard shell helmets having an outer shell, normally made of a thermoplastic material such as: NYLON, polycarbonate, or ABS with a thickness varying from 2 to 3 millimeters, an inner shell made of a deformable foam plastic such as expanded polystyrene styrofoam (EPS), a comfort liner inside the EPS foam shell, and a retention strap system attached directly to the outer hard shell;

(b) foam helmets having a relatively thick outer shell made of EPS, a comfort liner, and a retention system attached directly to the outer foam shell; and (c) microshell helmets having a thin outer microshell (0.2–0.5 millimeters thick) made of a thermoplastic vacuum-shaped material such as polyethylene or polyester over a relatively thicker inner plastic EPS foam shell and a comfort liner. Due to the thinner nature of the outer microshell, the retention strap system is attached to the EPS foam shell.

These known helmet constructions exhibit different degrees of protection for a wearer during crash impacts. The hard shell helmet absorbs part of the impact energy by deformation of the outer shell. The outer shell also distributes the impact energy to the inner EPS shell over a contact area larger than the impact area of the outer shell, and the remaining impact energy is absorbed by the deformation crush of the inner foam shell. Impacts on the hard shell helmet do not affect the retention strap system, because it is attached directly to the outer shell.

In a similar crash impact situation for the foam only helmet as well as for the microshell helmet, all the impact energy absorption work is provided by the EPS foam shell by direct deformation. However, this implies some negative consequences because the energy of impact is concentrated at a single point having the same area and dimensions as the impact-causing body or structure. Consequently, a thicker EPS foam shell is required to provide the same energy absorption capacity as the hard shell helmet. Also, for impacts occurring close to the lower edge of the foam helmet, and especially in proximity to the vent openings, cracking of the EPS foam shell becomes almost inevitable due to the wedging effect of the impact-causing body against the helmet. In some cases, a crash impact may cause the helmet to crack and break into multiple pieces, thereby destroying its usefulness.

If the foam helmet is submerged in water, as is required by most international standards and test procedures, the foam shell absorbs some quantity of water. The absorbed water penetrates the interstices between the plastic foam particles or spheres and, when compressed, the crash energy tends to separate the adjacent spheres thereby worsening the cracking phenomena described above. A cracked shell has a reduced energy absorption capacity, which in most cases is much lower than that required to meet the international safety standards. Moreover, a cracked helmet shell would completely void the function of the retention strap system. Finally, it is important to note that a cracked foam shell would not provide any useful protection to a wearer in the case of multiple impacts immediately occurring, one after the other, in an accident or crash.

Thus, it is apparent that an improved construction for protective helmets for cyclists is needed. The known prior art has provided various designs of protective helmets which are useful, such as disclosed by U.S. Pat. No. 4,443,891 to Blomgren et al., U.S. Pat. No. 4,472,472 to Schultz, U.S. Pat. No. 4,558,470 to Mitchell et al., U.S. Pat No. 4,612,675 and U.S. Pat. No. 4,653,123 to Broersma, and U.S. Pat. No. 4,845,786 to Chiarella. However, these helmets generally utilize bondable plastic members or unreinforced resilient padding to provide a shock absorption function. Thus, the prior art helmets do not provide proper combinations of light weight, high impact energy absorption and multiple impact protection, and ventilation which is desired by the helmet wearer.

SUMMARY OF INVENTION

This invention provides an improved protective helmet such as used by cyclists. The helmet is light weight, absorbs high energy, and can withstand multiple impacts thus providing maximum protection for a helmet wearer. In one embodiment, the helmet utilizes a formed shell of a shock absorbent plastic foam material, together with an infrastructure embedded at least partially or totally within the plastic foam shell material, so as to form an integral unit structure providing superior shock-absorbing characteristics. The infrastructure which is embedded into the foam shell has the purpose of binding together all portions of the formed foam shell into a strong integral structural unit, in a manner somewhat similar to the function of steel mesh or rods used in reinforced concrete construction. The infrastructure is essential for preventing breakage of the shell due to severe impact loadings and other similar causes thus providing maximum deformation absorption. Moreover, the combination of the infrastructure and foam shell provides, even when the shell does not break, a higher level of deformation than the shell without the infrastructure. A retention strap means may be attached to the helmet infrastructure for retaining the helmet comfortably and securely on the wearer's head.

The helmet infrastructure includes a peripheral ring member extending completely around its lower portion, at least one longitudinal strip member attached to the peripheral ring and extending longitudinally from the front to the rear part of the ring, and at least one transverse strip connecting the longitudinal strip from each side of the ring and connected to portions of the longitudinal strip.

The purpose of the helmet is to prevent impact energy from being transmitted from the impact zone to the wearer's head. The impact energy must be absorbed by the helmet. All helmet designs accomplish this purpose by attempting to provide a structure with maximum absorption deformation. It is the deformation absorption of the structure which provides the impact energy protection to the wearer.

The infrastructure is at least partially embedded within the foam shell so as to provide effective attachment between the infrastructure and foam shell. Openings are provided in the foam shell and the embedded infrastructure to provide necessary openings for adequate cooling and ventilation and to accommodate the aesthetic shape of the helmet. It is important for providing maximum impact protection by the helmet, that the infrastructure be integrated structurally into the foam shell. In helmet design, the purpose is to design a safe helmet with the least possible thickness, most ventilation and the least weight while providing an aesthetically pleasing design. The addition of the infrastructure to the foam shell permits a designer to increase the energy absorption around the ventilation holes while reducing the thickness or density of the foam shell and maintaining a safe overall structure. The shape of the infrastructure will vary according to the desired overall shape of the helmet.

In another useful embodiment, this invention including the infrastructure embedded at least partially within a plastic foam shell may additionally include either an outer thin plastic shell or a thicker relatively rigid outer shell which is attached to and surrounds the foam shell. Another advantage is that the strap retention means may be attached to the infrastructure through the foam shell, providing a stronger attachment.

Advantages and benefits derived from the invention include increased foam shell elasticity with substantial reduction of any cracking occurrence for the foam shell, increased absorption capability, improved retention strap system efficiency, and improved protection for the wearer's head in case of multiple impact crashes. Even if any cracks might occur in the foam shell, they are only superficial and do not extend throughout the shell. Moreover, where the strap retention system is attached to the infrastructure, the strength of the attachment means is not effected by any foam shell cracking and does not worsen the cracking phenomenon.

The protective helmet and helmet assembly are particularly useful for providing head protection for cyclists such as: motorcyclists, bicyclists, joggers, roller skaters and skateboarders.

BRIEF DESCRIPTION OF DRAWINGS

The invention will be further described by reference to the following drawings, in which:

FIG. 1 shows a perspective view of an embodiment of the invention showing a foam shell helmet incorporating an infrastructure embedded within the foam shell and retention strap means according to the invention;

FIG. 2 shows a plan view of the FIG. 1 helmet including an infrastructure and ventilation openings in the helmet;

FIG. 3 shows a perspective view of an alternative embodiment of the invention including an infrastructure embedded within a plastic foam shell and a thin outer microshell with retention strap means;

FIG. 4 shows a plan view of the FIG. 3 helmet embodiment and outer microshell;

FIG. 5 shows a transverse cross-sectional view taken at line 5—5 of FIG. 4;

FIG. 6 shows a longitudinal cross-sectional view of the helmet taken along line 6—6 of FIG. 4 and including the outer microshell;

FIG. 7 is a plan view of the infrastructure which is incorporated into the alternative embodiment of FIGS. 3-6;

FIG. 8 is an elevational view of the infrastructure which is incorporated into the alternate embodiment of FIGS. 3-6;

FIG. 9 is a transverse sectional elevation view of an infrastructure taken at line 9—9 of FIG. 7;

FIG. 10 shows a sectional elevational view of an outer shell helmet assembly containing a foam shell infrastructure embedded therein, together with inner padding and an adjustable retention strap means;

DESCRIPTION OF INVENTION

Figure 11:
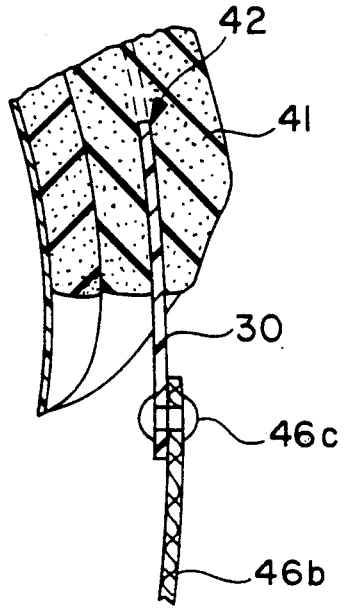
FIG. 11 is an enlarged cross sectional view taken along line 11—11 of FIG. 10.

As shown by FIG. 1, a protective helmet 10, such as worn by a cyclist, includes a formed concave-shaped plastic foam shell 11 and an infrastructure 12 which is shown embedded totally within foam shell 11. The helmet 10 is generally shaped to cover the portions of the head required to meet safety standards and to fit comfortably and securely on the head of a wearer, such as a bicycle rider. As is shown by FIG. 2, the foam shell 11 has a substantially uniform thickness as defined by the foam outer surface **11*a* and inner surface 11*b*. The infrastructure 12 as shown by phantom lines includes a peripheral band 13, at least one longitudinal strip member 14, and a transverse member 15 connected to the longitudinal member central portion and each member integrally connected to the peripheral band 13. The infrastructure 12 preferably contains a plurality of openings 12*a* which are spaced apart therein to reduce weight of the infrastructure without weakening it and to facilitate it being securely embedded into the foam shell 11. Use of the plastic infrastructure 12 embedded into the plastic foam shell 11 significantly increases the crash impact strength and energy absorption of the helmet 10** without requiring additional foam shell thickness, and also retains the desired helmet shape and integrity after any localized crushing of the foam shell that may occur.

The foam shell 11 contains at least two upper longitudinal vents 16*a*, 16*b* and 17*a*, 17*b* provided therein and extending through the shell 11 to provide ventilation for the helmet. Also if desired, additional longitudinal vent slots 18*a* and 18*b* can be provided along the lower side portions of the helmet. The infrastructure members are located so as to increase the strength and shock absorption of the foam shell adjacent the openings in the shell 11.

Figure 12:
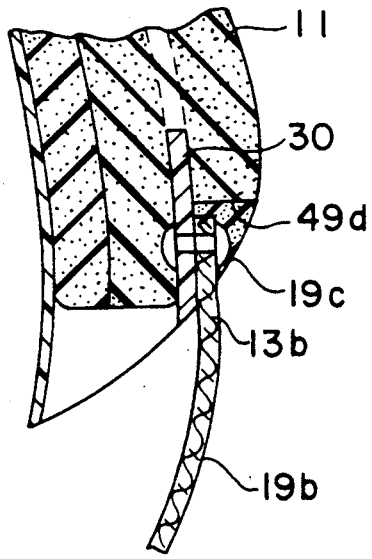
FIG. 12 is an enlarged cross sectional view taken along line 12—12 of FIG. 1.
Figure 13:
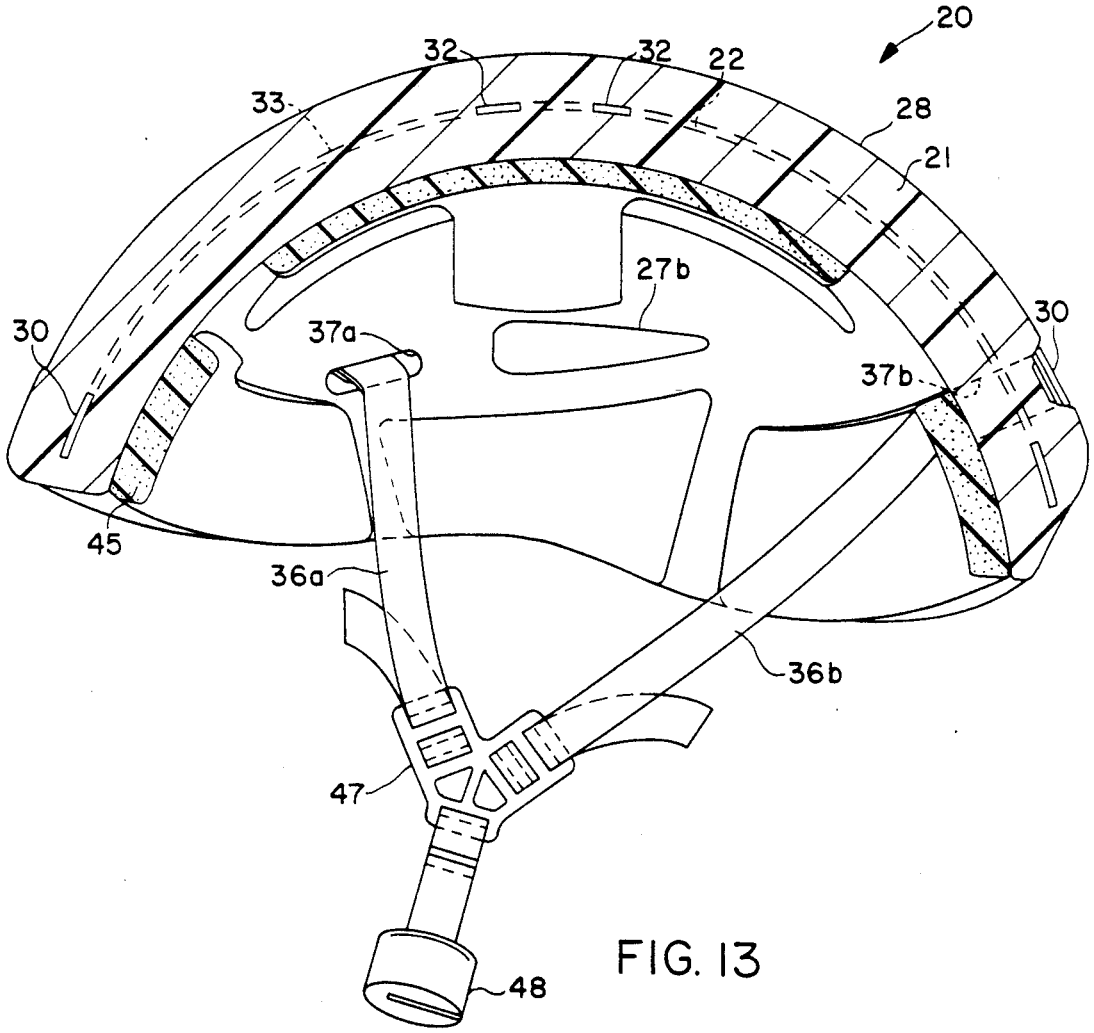
FIG. 13 is a sectional view similar to FIG. 6 showing an alternate embodiment of the invention.
Figure 14:
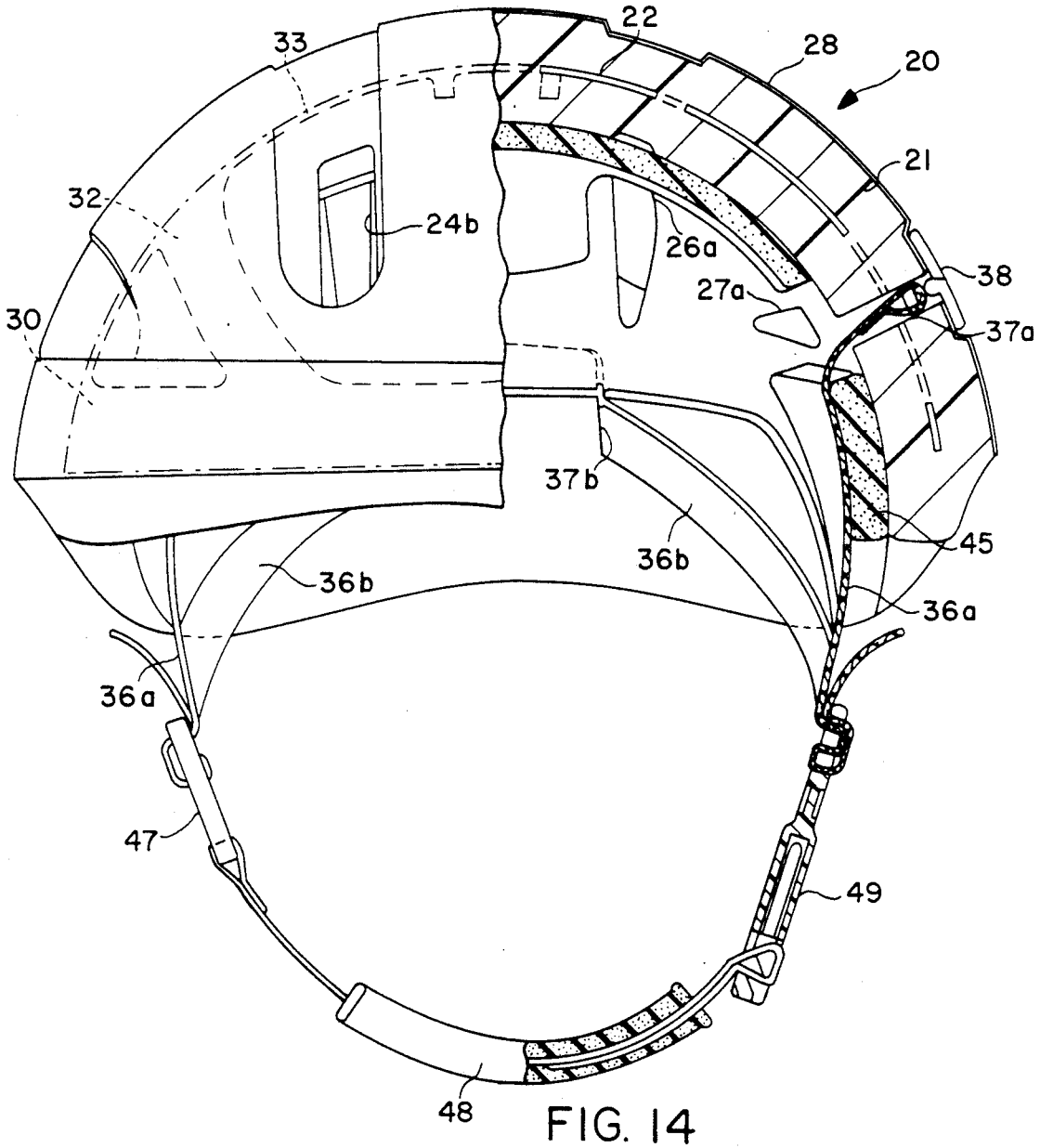
FIG. 14 is a front view of the invention, partially broken away and in cross section, of the embodiment shown in FIG. 13.

A retention strap means including flexible dual front straps 19*a* and dual rear straps 19*b* are attached firmly onto the peripheral band 13, such as by rivets 19*c*. Alternatively, if desired, the dual retention straps 19*a* and 19*b* can be attached onto downward extension portions 13*b* (see FIG. 12) of the peripheral band 13. As shown in FIG. 12, a recess 19*d* is provided in the foam shell 11 to allow riveting of the rear strap 19*b* at portion 13*b*, as by rivet 19*c*.

An alternative embodiment for a protective helmet 20 according to the invention is shown by FIGS. 3–6. In this alternative construction, the helmet 20 includes a foam shell 21 and an infrastructure 12 or 22 which is embedded within the foam shell 21. As seen in FIGS. 3 and 4, the foam shell 21 contains four longitudinal slots 24*a*, 24*b* and 26*a*, 26*b*, which each extend through the foam shell 21, and preferably includes dual inner passageways 25*a* extending between the front and rear vents 24 and 26, respectively, to facilitate ventilation of the helmet. The foam shell 21 also preferably contains two lower longitudinal vents 27*a* and 27*b* located along the sides of the helmet 20.

The formed foam shells 11 and 21 are each made of a plastic foam material which has good impact and shock absorption characteristics, such as expanded high density polystyrene foam. The infrastructure 22 includes a lower peripheral ring member 30, to which is attached at least two longitudinal strip members 32, and at least one transverse strip member 33 connecting the two longitudinal strips 32 together at near their central portions, as is generally shown by phantom lines in FIGS. 3 and 4. The infrastructure 22 also preferably has short dual connecting members 34*a* and 34*b* provided between the central portion of each longitudinal strip 32 and the peripheral ring 30. Use of the plastic infrastructure 22 embedded within the foam shell 21 serves to significantly increase the impact strength and shock absorption of the helmet 20, and also retains the desired helmet shape after any localized crushing of the foam shell that may occur. Also, the impact energy absorption capacity of the helmet is substantially increased at locations adjacent the vent openings by providing the infrastructure members near the edge of such vent openings. The helmet shell 11 and 21 each have a total thickness of at least 0.9 inches (22 mm) and not exceeding 1.12 inches (28 mm).

The helmet unit 20 can be advantageously and preferably provided with a thin outer plastic layer or microshell 28 made of plastic material molded into the surface 21*a* of foam shell 21, as shown in FIGS. 5 and 6. This outer microshell material, which has a thickness of about (0.5–0.8 mm) 0.02–0.32 inches, is folded downwardly at least partially into the vents 24, 26 and 27, and thereby serves to additionally strengthen the foam shell 21 against impact loading.

FIGS. 5 and 6 show transverse and longitudinal sectional views respectively, of the foam shell 21 and the infrastructure 22 which is embedded into the foam shell. The vents 24*a*, 24*b* and 26*a*, 26*b* are located intermediate the longitudinal and transverse members 32, 33 of the infrastructure 22, as generally shown by FIGS. 3–5. Although the infrastructure members 30, 32 and 33 are shown preferably embedded in a central portion of the foam shell 21, they can alternatively be advantageously provided embedded at other positions within the shell 21.

The helmet 20 is retained securely on the wearer's head by a retention strap means which includes flexible dual front straps 36*a* and dual rear straps 36*b*, as shown by FIGS. 3, 5 and 6. As an alternative arrangement, the two front straps 36*a* are each passed through a slot 37*a* in the foam shell 21 and are attached to an outer plate 38 which is recessed into outer microshell 28, as generally shown in FIGS. 3, 5 and 6. Similarly, the two rear straps 36*b* are each passed through a slot 37*b* in the rear portion of the foam shell 21, and are attached to a plate 39 which is recessed into outer microshell 28 of the helmet.

The concave-shaped infrastructure 12 and 22 are made of a molded plastic material such as polypropylene which is easily embedded into the plastic foam shell 11 and 21, usually made of polystyrene foam. The infrastructure 22 embedded in foam shell 11 and 21 provides multiple impact crash protection and permits design variations not previously available and yet still capable of meeting the appropriate international standards. ANSI 90.4 or SNELL B84 standards. The infrastructure dimensions are approximately 0.040–0.080 inch (1–2 mm) thick and 0.20–1.0 inch (5–25 mm) wide.

The infrastructure 22 is shown in greater detail in FIGS. 7 and 8. To facilitate the infrastructure 22 being securely embedded into the plastic foam shell 21, the infrastructure may be provided with a plurality of openings 22*a* which are spaced apart therein to reduce its weight, without weakening it, and to facilitate it being integrated into the foam shell 21. Also, a plurality of upward extensions 30*a* may be provided in peripheral ring 30 to facilitate its attachment into foam shell 21, as shown in FIGS. 7 and 8. The openings 22*a* are additionally provided in the longitudinal members 32 and upper cross strip member 33 of the infrastructure 22.

The helmet can also be advantageously used in a helmet assembly 40, which includes formed foam shell 41 having an infrastructure 42 embedded therein, and has a rigid outer protective shell 44 to which the foam shell 41 is firmly attached, as generally shown by FIG. 10. The outer rigid shell 44 has a thickness of 0.080–0.16 inch (2–4 mm). Also, a soft resilient comfort liner 45 is provided inwardly from and attached to the inner surface of foam shell 41. The comfort liner can be secured by any method of attachment as known to one skilled in the art, but preferably by the "looped" threading ("pile") and correspondingly mating "hook" attachments 45*a*, such as those marketed under the trademark Velcro, ® to permit the helmet 40 to fit comfortably on the wearer's head. A soft resilient comfort line is usually provided with all helmet styles. In addition, front and rear retention straps 46*a* and 46*b* are preferably attached through appropriately located slots in foam shell 41 to the helmet outer shell. The retention straps 46*a*, 46*b* are joined at 47 to an adjustable chin strap 48 having a quick release buckle 49 to retain the helmet securely onto the wearer's head. Alternatively, if desired, the retention straps 46*a*, 46*b* can be attached to the peripheral band 30 of the infrastructure 42 of the helmet such as by rivets 46*c*, as generally shown in FIGS. 10 and 11.

Materials useful for the forward plastic foam shells 11 and 21 include all light weight plastic materials having good molding and shock absorption characteristics, such as expanded polystyrene.

Materials useful for the infrastructure 12 include all plastic materials having good mechanical characteristics and which are capable of being embedded to the foam shell 11, such as polypropylene, polyammides (nylon), polycarbonate and similar materials. The infrastructure material alone does not particularly influence the shock absorption characteristics of the helmet, as it is the infrastructure and in-foam molding combination that provide the high shock resistance and cohesion capacity of the helmet 10.

This invention will be better understood by reference to the following example, which should not be construed as limiting the scope of the invention.

EXAMPLE 1

Comparative impact tests were conducted in accordance with the SNELL FOUNDATION B84 standard testing procedures on a foam helmet as shown in FIG. 3 with and without use of the internal infrastructure under various typical conditions of helmet usage. Results of these helmet drop tests showing peak G loadings recorded by an accelerometer device on a headform within the helmet are provided in Table 1 below.

TABLE 1

Comparison of Impact Loadings on Helmets

| Test No. | Test Condition | Impact Site On Helmet | Peak G Loading Without Internal Infrastructure | Peak G Loading With Infrastructure |
|---|---|---|---|---|
| 1 | Water submerged | Front | 477 | 101 |
| 2 | Water submerged | Side | 498 | 116 |
| 3 | Hot (122° F.) | Side | 228 | 198 |
| 4 | Cold (−4° F.) | Side | 126 | 98 |

The maximum allowed acceleration loading which can be transmitted to the head of a helmet wearer according to the SNELL FOUNDATION B84 test standard is 330 G. For conditions 1 and 2, it is noted that peak G acceleration loadings recorded for helmets constructed without the internal infrastructure substantially exceeded the allowed 330 G limit. It was not possible to perform the strap retention test on these helmets because they broke into several pieces during the impact test. In significant contrast, for helmets with the internal infrastructure, the peak G loading was substantially below the allowable G limit and they passed the strap retention tests.

For test conditions 3 and 4, although peak G loadings were both less than the allowed 330 G limit, it is noted that the measured G loadings for identical helmets with internal infrastructure were only 77–87% of loadings measured for identical helmets without the infrastructure. Thus, it is apparent that use of the infrastructure within the plastic foam shell provides a much safer helmet construction and provides the designer with more possible design variations.

Although this invention has been described broadly and in terms of certain preferred embodiments, it will be understood that modifications and variations can be made to the invention as defined within the scope of the following claims.

I claim:

1. A protective helmet to be worn on the head of a wearer, comprising:

a foam shell comprising a formed concave-shaped layer of plastic foam material having substantial impact energy absorptive characteristics;

an infrastructure having a plurality of elongated members embedded at least partially within said foam shell and, wherein said elongated members comprise:

a ring shaped member extending around the lower portion of the infrastructure;

at least one elongated strip member connected to the ring shaped member and extending longitudinally relative to the infrastructure; and at least one transverse strip connecting with said ring shaped member and said elongated longitudinal strip member; and wherein said infrastructure contains a plurality of openings spaced apart in the ring shaped and elongated members; and a retention strap means attached to said infrastructure so as to retain the helmet on the wearer's head.

2. A protective helmet to be worn on the head of a wearer, comprising:

a foam shell comprising formed concave-shaped layer of plastic foam material having substantial impact energy absorptive characteristics;

an infrastructure having a plurality of elongated members embedded at least partially within said foam shell, wherein said elongated members comprise:

a ring shaped member extending around the lower portion of the infrastructure, wherein said ring shaped member contains a plurality of extensions to facilitate bonding of the infrastructure to said foam plastic shell;

at least one elongated strip member connected to the ring shaped member and extending longitudinally relative to the infrastructure; and at least one transverse strip connecting with said ring shaped member and said elongated longitudinal strip member; and wherein said infrastructure contains a plurality of openings spaced apart in the ring shaped and elongated members; and a retention strap means attached to said infrastructure so as to retain the helmet on the wearer's head.

3. A protective helmet to be worn on the head of a wearer, comprising:

a foam shell formed concave-shaped layer of plastic foam material having substantial impact energy absorptive characteristics;

an infrastructure having a plurality of elongated members embedded at least partially within said foam shell, wherein said elongated members comprise:

a ring shaped member extending around the lower portion of the infrastructure;

at least one elongated strip member connected to the ring shaped member and extending longitudinally relative to the infrastructure; and at least one transverse strip connecting with said ring shaped member and said elongated longitudinal strip member;

a retention strap means attached to said infrastructure so as to retain the helmet on the wearer's head, wherein said infrastructure member has thickness of 0.040–0.080 inch and width of 0.4–1.0 inch.

4. A reinforcement dome-shaped infrastructure for use in a protective helmet, said infrastructure, comprising:

a peripheral ring member extending around the lower portion of the infrastructure;

at least one elongated strip member connected to the peripheral ring member and extending longitudinally relative to the infrastructure;

at least one cross strip member connects said longitudinal member central portion to said peripheral ring member; and wherein said peripheral ring and elongated members contain a plurality of openings to facilitate the infrastructure being embedded firmly into a foam plastic shell.

* * * * *